US006097788A

United States Patent [19]

Berenstein et al.

[11] Patent Number: 6,097,788

[45] Date of Patent: Aug. 1, 2000

[54] METHOD AND APPARATUS FOR MULTI-PLANAR RADIATION EMISSION FOR IMAGING

[75] Inventors: Alex Berenstein, New York, N.Y.; Norbert Krause, Schwarzenbach/Saale; Johann Seissl, Erlangen, both of Germany

[73] Assignee: Siemens Aktiengesellschaft, Munich, Germany

[21] Appl. No.: 09/059,439

[22] Filed: Apr. 14, 1998

[51] Int. Cl.[7] ..... H05G 1/70

[52] U.S. Cl. ..... 378/92; 378/62

[58] Field of Search ..... 378/92, 62; 250/370.08, 250/370.09

[56] References Cited

U.S. PATENT DOCUMENTS

| | | | |
|---|---|---|---|
| 3,440,422 | 4/1969 | Ball et al. | 378/92 |
| 3,999,044 | 12/1976 | Grim | 378/92 |
| 5,923,721 | 7/1999 | Duschka | 378/92 |

FOREIGN PATENT DOCUMENTS 2523886 12/1976 Germany .

*Primary Examiner*—David V. Bruce
*Assistant Examiner*—Drew A. Dunn
*Attorney, Agent, or Firm*—Sughrue, Mion, Zinn, Macpeak & Seas, PLLC

[57] ABSTRACT

An multi-planar radiation emission system, preferably an X-ray biplanar transillumination system, for generating planar images of a subject from different perspectives includes a first X-ray source which emits first pulses of X-ray radiation toward a subject from a first direction at a first repetition rate, a first imaging device which detects the first pulses and generates a first image of the subject from a first perspective, a second X-ray source which emits second pulses of X-ray radiation toward the subject from a second direction at a second repetition rate which is different from the first repetition rate, wherein the first and second pulses are temporally interleaved and non-overlapping, and a second imaging device which detects the second pulses and generates a second image of the subject from a second perspective. The first and second images are preferably planar images which are "moving" images in the sense that information from successive pulses is used to periodically update the planar images on a display. The relative reduction of the pulse repetition rate of the pulses used to generate one of the two planar images advantageously reduces potentially harmful X-ray emissions and reduces the image processing required to generate the planar images without significantly sacrificing useful information, since one of the two images is generally referred to only occasionally to provide the observer with a three-dimensional perspective of the planar image of greater interest.

46 Claims, 3 Drawing Sheets

METHOD AND APPARATUS FOR MULTI-PLANAR RADIATION EMISSION FOR IMAGING

BACKGROUND OF THE INVENTION

1. Field of the Invention

The present invention relates to an imaging method and apparatus for performing multi-planar illumination of a subject, such as parts or organs of the human body. Specifically, the present invention relates to a bi-planar X-ray system capable of simultaneously depicting details of the subject from two different (e.g., orthogonal) perspectives with a reduced amount of exposure to X-ray radiation.

2. Description of the Related Art

Conventionally, biplanar transillumination X-ray systems have been used to create two, quasi-simultaneous images of physiological details of a subject, such as parts or organs of the human body, from two different perspectives. Such images are useful for identifying the location and orientation of bones, organs, arteries and the like and provide significant information which can be used to safely perform critical interventional operations. Further, a sequence of biplanar X-ray images taken over time can be used to visualize, from two perspectives, the progression of an X-ray sensitive dye through arteries or organs in order to monitor the perfusion of blood or medication or to determine the location of blockages therein.

An example of a conventional biplanar X-ray imaging system is disclosed in U.S. Pat. No. 3,440,422 to Ball et al., incorporated herein by reference in its entirety. The system disclosed by Ball et al. includes a first X-ray tube that emits X-ray pulses which travel through a subject and are amplified by an image amplifier tube. The image amplifier tube projects amplified pulse signals onto a photographic film, thereby exposing the film. The first X-ray tube, amplifier and film are oriented relative to the subject, such that an anterior-posterior (AP) two-dimensional image of the subject is formed on a frame of the film for each pulse. The film is advanced with successive pulses, such that a sequence of pulses forms a series of film frames which constitute a moving picture. A second X-ray tube emits X-ray pulses which travel through the subject in a direction substantially orthogonal to the direction of the pulses of the first X-ray tube. The pulses from the second X-ray tube are amplified by a corresponding amplifier tube, and the amplified pulse signals are projected onto a second film to form lateral two-dimensional images of the subject. Thus, moving pictures of the frontal and side views of the subject are respectively formed on the first and second films.

According to the system disclosed by Ball et al., the pulse repetition rate and the pulse duration of the pulses emitted from the first and second X-ray emitters can be adjusted by selecting a frame rate and an exposure time from a selector panel. Importantly, however, pulses must be alternately emitted from the first and second X-ray tubes, and the pulse repetition rate and pulse duration of the pulses from the first and second X-ray tubes cannot differ (i.e., the pulse repetition rates and pulse durations of the two X-ray tubes cannot be adjusted independently). Specifically, the system is capable of generating only alternating pulses, since both X-ray tubes are triggered from different phases of the same oscillating signal.

Similarly, the system disclosed in German Examined Appl. No. 25 23 886 B2 to Stohr provides for an adjustable pulse repetition rate with improved synchronization during rate changes, but does not permit different pulse repetition rates. Like the system disclosed in Ball et al., the first and second X-ray emitters disclosed by Stohr always alternately emit pulses; thus, the pulse repetition rates of the two X-ray emitters cannot differ and cannot be set independently. A timing diagram illustrating the sequence of pulses emitted from the first (waveform A) and second (waveform B) X-ray tubes of such conventional systems is shown in FIG. 1.

SUMMARY OF THE INVENTION

While these conventional biplanar transillumination X-ray systems provide images of the subject from two different perspectives, they require twice the amount of X-ray emission as a comparable monoplanar transillumination system; hence, the subject (generally a patient) and clinical personnel in the vicinity of the subject are exposed to twice as much X-ray radiation. Moreover, conventional biplanar transillumination X-ray systems require an increase (doubling) of the demand placed on the efficiency of the image processing system. Unfortunately, this doubling of exposure to radiation and doubling of image processing do not imply a doubling in the usefulness of the image information resulting therefrom, since the user of the system can concentrate only on a single information source (one image) at a time. This is particularly true in the case of real time imaging systems, where the images are immediately displayed on a display device and clinical decisions are made as the images are viewed. The second source of information (one of the two moving images generated by the biplanar transillumination system) can therefore be utilized only sporadically in short increments of time in order to gain a three-dimensional impression and/or to better assess the overall situation.

Therefore, there is a need for a biplanar transillumination system capable of providing images of a subject from two different perspectives while minimizing the overall exposure to radiation and reducing the amount of image processing necessary to generate the images.

Accordingly, it is an object of the present invention to provide an improved multi-planar radiation emission system for imaging.

Another object of the present invention is facilitating X-ray biplanar transillumination of a subject with reduced X-ray radiation.

It is a further object of the present invention to provide X-ray biplanar transillumination of a subject with reduced image processing requirements.

Another object of the present invention is to allow selective and independent control of the pulse repetition rates of two X-ray emitters of a biplanar transillumination system.

Still another object of the present invention is to provide flicker-free images in both planes of a biplanar transillumination system.

Yet another object of the present invention is to provide rapid switching of the primary plane (the image plane having the higher pulse repetition rate) from one of the X-ray emitters to the other of the X-ray emitters.

The aforesaid objects are achieved individually and in combination, and it is not intended that the present invention be construed as requiring two or more of the objects to be combined unless expressly required by the claims attached hereto.

In accordance with the present invention, these and other objects are achieved by an apparatus for generating images of a subject, including: (i) a first energy source emitting first pulses of radiation at a first repetition rate, the first pulses being incident on the subject from a first direction; (ii) a first detector disposed to detect the first pulses after the first pulses have interacted with the subject; (iii) a second energy source emitting second pulses of radiation at a second repetition rate which is different from the first repetition rate, the second pulses being incident on the subject from a second direction and being temporally interleaved with the first pulses such that the first and second pulses are temporally non-overlapping; (iv) a second detector disposed to detect the second pulses after the second pulses have interacted with the subject; and (v) an imaging device for generating images of the subject based on the first and second pulses respectively detected by the first and second detectors.

More particularly, the objects are achieved in a biplanar transillumination system having a first X-ray source which emits first pulses of X-ray radiation toward a subject from a first direction at a first repetition rate, a first imaging device which detects the first pulses and generates a first image of the subject from a first perspective, a second X-ray source which emits second pulses of X-ray radiation toward the subject from a second direction at a second repetition rate which is different from the first repetition rate, wherein the first and second pulses are temporally interleaved and non-overlapping, and a second imaging device which detects the second pulses and generates a second image of the subject from a second perspective. The first and second images are preferably planar images which are "moving" images in the sense that information from successive pulses is used to periodically update the planar images on a display.

The present invention takes advantage of the fact that an observer can study only one image at a time, and one of the two images is generally of primary interest, while the other image is generally of secondary interest (e.g., it is referred to only occasionally to gain a three-dimensional perspective of the primary image). In accordance with the present invention, the pulse repetition rate of the X-ray pulses used to form the secondary planar image (i.e., the planar image of lesser interest to the observer) is significantly less than and is preferably a small fraction of the pulse repetition rate of the X-ray pulses used to form the primary planar image (i.e., the planar image of greater interest to the observer). The reduction of the pulse repetition rate used to generate the secondary planar image advantageously reduces potentially harmful X-ray emissions and reduces the image processing required to generate the two planar images. This reduction in radiation and processing can be achieved without a significant sacrifice in useful information, given that the secondary image is referred to only occasionally. In other words, it is less critical to continuously update the secondary image at a high rate. The lower pulse repetition rate of the pulses used to generate the secondary image provides sufficient information to generate an acceptable secondary planar image in terms of the image adjustment rate.

According to a preferred embodiment, the primary and secondary planar images are simultaneously displayed on a display device as moving images in real time (i.e., the images are displayed as the pulses are detected and processed). The observer can select which of the two planar images is the primary image and which is the secondary image and can selectively set the first and second pulse repetition rates. Further, the user can rapidly change which of the two planar images is the primary planar image via an interchange of the two pulse repetition rates. Flicker-free depiction can be achieved for both planar images by utilizing a gap-fill memory.

According to one embodiment of the present invention, each of the primary and secondary sequences of pulses is itself a periodic sequence of pulses, i.e., the interval between successive primary pulses is constant and the interval between successive secondary pulses is constant. To avoid temporal overlap, each secondary pulse is emitted during the time period between two successive primary pulses, and the pulse repetition rate of the primary pulses is preferably an integer multiple of the pulse repetition rate of the secondary pulses.

According to another embodiment of the present invention, the sequence of interleaved pulses formed of primary and secondary pulses is a periodic sequence of pulses, wherein the sequence of primary pulses, taken alone, is not periodic. That is, the sequence of primary pulses is a periodic sequence of pulses with the omission of every "nth" pulse, and the secondary pulses are emitted during the omission periods in the sequence of primary pulses.

The above and still further objects, features and advantages of the present invention will become apparent upon consideration of the following detailed description of a specific embodiment thereof, particularly when taken in conjunction with the accompanying wings wherein like reference numerals in the various figures are utilized to designate analogous elements.

DESCRIPTION OF THE PREFERRED EMBODIMENTS

Figure 2:
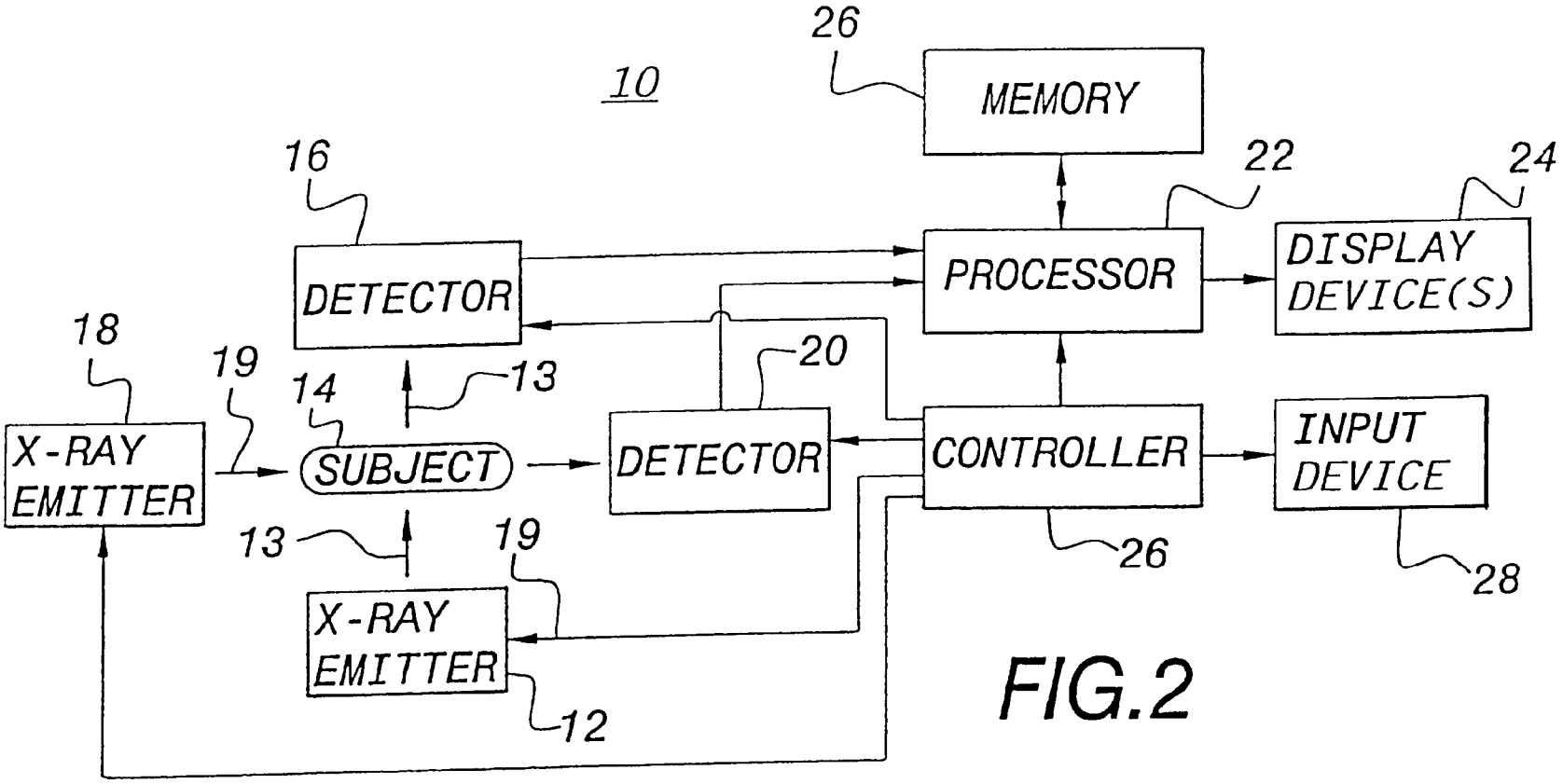
FIG. 2 is a diagram illustrating a biplanar transillumination device according to a preferred embodiment of the present invention.
Figure 5:
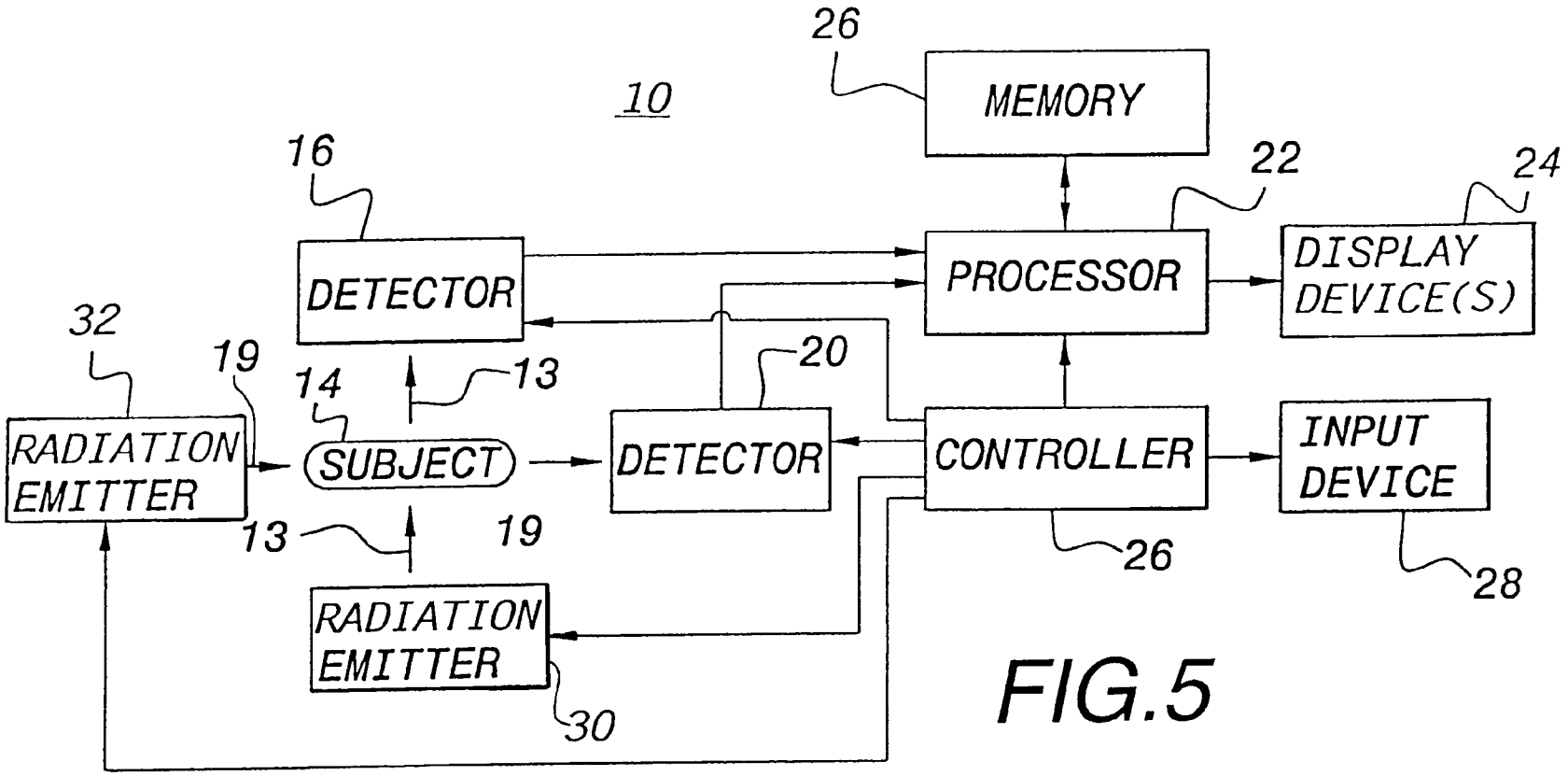
FIG. 5 is a diagram illustrating a biplanar transillumination device according to another preferred embodiment of the present invention.

FIG. 2 is a diagram illustrating an X-ray biplanar transillumination system 10 according to a preferred embodiment of the present invention. The X-ray system 10 includes a first X-ray emitter 12 which emits pulses of X-ray radiation in a direction 13 toward a subject 14. The X-ray emitter 12 can be any conventional X-ray pulse producing device, including, but not limited to, an X-ray tube powered by a high-voltage transformer, such as that disclosed in the above-described patent to Ball et al., or other radiographic equipment or an equivalent.

The subject 14 can be any object that has a non-uniform transmissivity to X-ray radiation. For example, the subject can be a part of a living organism, such as the bones, organs, muscles, connective tissues (e.g., ligaments and tendons), arteries or veins of a human body.

A first detector 16 is disposed on a side of the subject 14 opposite that of X-ray emitter 12, such that subject 14 is positioned directly between X-ray emitter 12 and detector 16. The X-ray pulses emitted by emitter 12 in direction 13 are at least partially transmitted through subject 14 in accordance with the transmissivity of the various components of subject 14 and detected by detector 16.

The detector 16 can be any conventional analog or digital detection device capable of quantifying an amount of received X-ray radiation over a plane normal to the direction 13 of radiation. That is, the detector 16 must be capable of detecting different levels of X-ray radiation over a planar field from which a two-dimensional image showing structural details of the subject 14 can be formed. The detector 16 can be, for example, a two-dimensional array of detector elements. Alternatively, the detector 16 can be an energy storing or registering surface, such as a phosphor sheet or a photographic film. Detector 16 preferably includes an image intensifier or an amplifier for amplifying the detecting image signal.

X-ray emitter 18 is similar to emitter 12 and emits pulses of X-ray radiation in a direction 19 toward the subject 14. Direction 19 preferably is oriented substantially at an angle of 90° relative to direction 13. In general, the angular offset between directions 13 and 19 can be any angle and may be adjustable. A second detector 20 is disposed on a side of the subject 14 opposite that of X-ray emitter 18, such that subject 14 is positioned directly between X-ray emitter 18 and detector 20. The detector 20 receives the X-ray pulses emitted by emitter 18 and transmitted through the subject 14.

Each of detectors 16 and 20 sends to a processor 22 detection signals which provide a two-dimensional (i.e., planar) representation of the amount of X-ray radiation detected. Processor 22 performs the necessary image processing for converting the detection signals into image data that can be displayed on a display device 24. For example, processor 22 can perform analog-to-digital conversion of the detection signals, image filtering and sharpening operations, multiple-pulse image integration, image intensity scaling required to make the image intensity and contrast suitable for the particular display device 24, and any other conventional image data processing and signal processing required to generate displayable image data from the detection data. It should be noted that each pulse can be used to generate an updated image for display on display device 24. Alternatively, multiple pulses (from the same emitter) can be integrated into a single image prior to updating the display 24. Preferably, the two planar images are displayed simultaneously or quasi-simultaneously, meaning that the two planar images are simultaneously viewable but are updated at different points in time to reduce interference at each detector caused by scattering of the pulses from the non-corresponding emitter. Of course, where the detectors 16 and 20 include exposable films, the film may be developed and viewed with a film projection device without intervening signal processing. Optionally, the system 10 further includes a memory 26 for storing image data.

Display 24 can be any conventional image display device including, but not limited to, a cathode ray tube, a liquid crystal display, a light emitting diode array and a film displaying device. Display 24 can be a single display unit with two separate viewing windows for viewing two planar images or two separate display units. The planar images displayed on display 24 are preferably "moving" images, resulting from the fact that the planar images are updated several times each second, as new image information from the continuing sequence of X-ray pulses is received and processed (thus, the "moving" images are in fact a rapid sequence of snap-shot-like images). Of course, the update rate can be reduced to a level where the viewer no longer gets the impression of a moving image, but rather a periodically updated still image.

Preferably, the moving planar images are processed in "real time" and displayed in an "on-line" mode, meaning that the detected X-ray pulses are immediately processed and displayed at a rate that is consistent with the rate at which X-ray pulses are received, such that the displayed image does not "fall behind" the detection of X-ray pulses. Generally, real time operation requires that, on average, the processing necessary to display a received unit of information can be completed in an amount of time that is no more than the time interval between reception of successive units of information. Consequently, real time display of planar image data puts constraints on the amount of image processing that can be performed for each X-ray pulse emitted and detected. Optionally, the image signals can be stored for later review.

According to another mode of operation, the detected signals can be stored (without generating an image) and later processed and viewed "off-line." This mode of operation requires real-time storage of signals but not real time processing and displaying of image signals.

The pulse repetition rates of X-ray emitters 12 and 18 are controlled by controller 26. Controller 26 can include conventional components which trigger an X-ray emitter to emit X-ray pulses. Importantly, however, the controller 26 provides independent control of the pulse repetition rates and pulse durations of the pulses emitted by X-ray emitters 12 and 18. Specifically, in contrast to the conventional systems of Ball et al. and Stohr described above, the pulses emitted by emitters 12 and 18 need not alternate, and the pulse repetition rates and pulse durations of the pulses emitted by emitters 12 and 18 need not be the same. Note, however, that emitters 12 and 18 are preferably synchronized with each other to the extent that their pulses do not temporally overlap, as explained below in further detail.

Controller 26 controls detectors 16 and 20 in synchronization with emitters 12 and 18, respectively. Specifically, the energy collection intervals of detectors 16 and 20 are set to correspond to the expected arrival times and durations of the pulses emitted by emitters 12 and 18. Further, controller 26 sends processor control information to the processor 22 to inform the processor 22 of the information being generated by the detectors 16 and 20 and to specify processing parameters. Additionally, controller 26 sends display control commands to the display 24 either directly or via processor 22.

In accordance with a preferred embodiment of the present invention, the pulse repetition rate of X-ray emitter 12 is different from the pulse repetition rate of X-ray emitter 18. Specifically, the pulse repetition rate of one of the X-ray emitters is maintained at a level similar to that of an X-ray emitter in a conventional X-ray biplanar transillumination system, while the pulse repetition rate of the other of the X-ray emitters is maintained at a fraction of the rate of the higher-rate X-ray emitter.

Reduction of the pulse repetition rate of one of the X-ray emitters advantageously reduces the X-ray radiation exposure of the subject 14 (which is generally a human) and any medical personnel in the vicinity of the subject 14. Additionally, the reduction of the pulse repetition rate advantageously reduces the amount of image processing required. The reduction in image processing can be particularly advantageous in the case of real time operation, where strict constraints on the amount of time available for processing image data may exist. The reduction of the pulse repetition rate of one of the X-ray emitters does not result in a significant reduction in the amount of useful image information available to the observer. As previously explained, under typical conditions (e.g., real time operation), a user tends primarily to observe only one of the two planar images (the primary planar image), and observes the other planar image (the secondary planar image) only intermittently in order to gain a three-dimensional perspective of what is seen in the primary planar image. Consequently, it is not necessary to update the information in the secondary planar image at as high a rate as that of the primary planar image, since the additional information provided by a higher image update rate (or X-ray pulse repetition rate) in the secondary planar image would generally be ignored by the user. As explained below in greater detail, the pulse repetition rate of the X-ray pulses used to generate the secondary planar image is set to a level sufficient to provide an image suitable for intermittent or occasional reference by the user.

As shown in FIG. 2, the X-ray biplanar transillumination system 10 includes an input device 28 which allows a user to enter data used by the controller 26 to control the X-ray emitters 12 and 18. In particular, the input device 28 allows the user to selectively and independently set the pulse repetition rates of the X-ray emitter 12 and the X-ray emitter 18. Optionally, the input device 28 provides for selection of pulse durations as well. The input device can be used to enter image display and image processing parameters which are sent to the display 24 and the processor 22 via controller 26. The input device can be any one or any combination of conventional devices, including, but not limited to, a keyboard, a keypad, a foot pedal, a touch screen or an LCD display.

Figure 1:
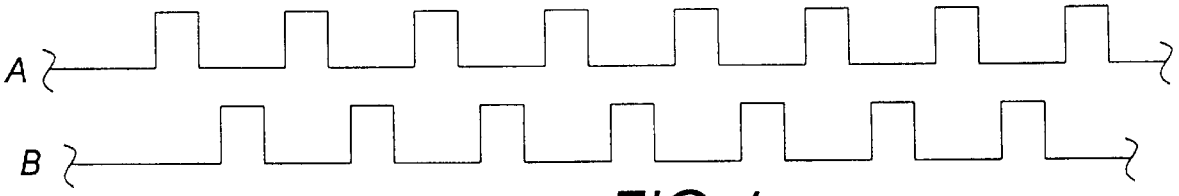
FIG. 1 (PRIOR ART)
FIG. 1 is a timing diagram illustrating the sequence of X-ray pulses generated by two X-ray sources of a conventional X-ray biplanar transillumination imaging system.
Figure 3:
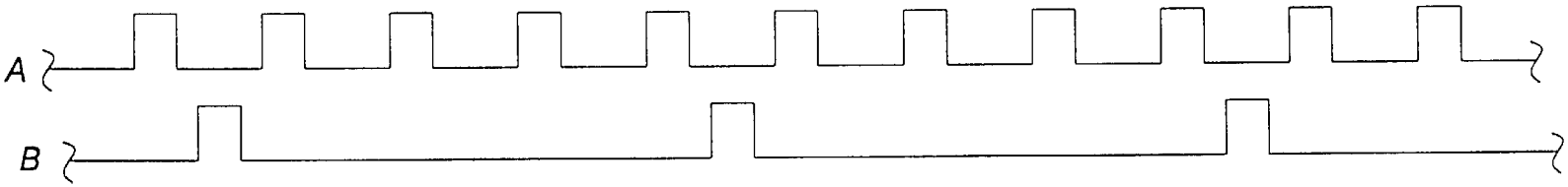
FIG. 3 is a timing diagram illustrating the sequence of X-ray pulses generated by the primary and secondary X-ray sources in accordance with a preferred embodiment of the present invention.

In accordance with one embodiment of the present invention, controller 26 controls X-ray emitter 12 to generate a periodic sequence of X-ray pulses at a first, user-specified pulse repetition rate, and controls X-ray emitter 18 to generate a periodic sequence of X-ray pulses at a second, user-specified pulse repetition rate. FIG. 3 is a timing diagram illustrating an example of a sequence of pulses generated by X-ray emitter 12 (waveform A) and a sequence of pulses generated by X-ray emitter 18 (waveform B) in accordance with this embodiment. In this example, the pulse repetition rate of emitter 12 is four times that of emitter 18; thus, the detections from detector 16 are used to generate the primary planar image, while the detections from detector 20 are used to generate the secondary planar image. As seen in FIG. 3, both waveform A and waveform B are themselves periodic, i.e., the time interval between pulses in either waveform is constant. In order to avoid overlap of pulses from the two emitters 12 and 18, the pulse repetition rate of the pulses used to form the primary planar image is preferably an integer multiple of the pulse repetition rate of the pulses used to form the secondary planar image. That is, interleaving of the pulses from the two sources is simplified by an integer multiple relationship between the two pulse repetition rates, since one or both of the pulse sequences can be made periodic, as shown in FIG. 3.

To illustrate the reduction in radiation resulting from the features of the present invention, consider an example of a conventional X-ray biplanar transillumination, where both emitters emit 30 pulses/second for a total of 60 pulses/second. According to the present invention, the primary and secondary pulse repetition rate can be set to 27 pulses/second and 3 pulses/second, respectively, for a total 30 pulses/second, or one half of the net radiation of the conventional system. A similar result can be achieved by respectively setting the primary and secondary pulse repetition rates to 25 pulses/second and 5 pulses/second, or 24 pulses/second and 6 pulses/second. Note that, in each example, the primary pulse repetition rate remains roughly similar to the conventional pulse repetition rate in order to minimize degradation in the update rate of the primary planar image. Of course, the primary and secondary pulse repetition rates can be set to any two, different rates. However, if the primary pulse repetition rate is not an integer multiple of the secondary pulse repetition rate, to avoid temporal pulse overlap, at least one of the two pulse sequences cannot be strictly periodic.

Figure 4:
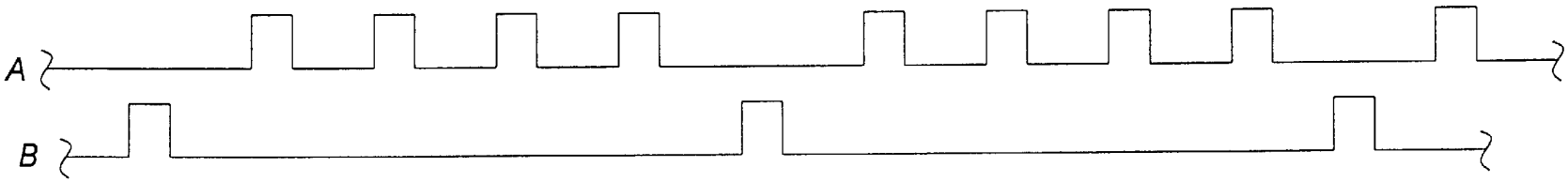
FIG. 4 is a timing diagram illustrating the sequence of X-ray pulses generated by the primary and secondary X-ray sources in accordance with another preferred embodiment of the present invention.

According to another embodiment of the present invention, a sequence of interleaved pulses formed of the primary and secondary pulses (from both emitters) is itself a periodic sequence of pulses, wherein the sequence of primary pulses, taken alone, is not strictly periodic. FIG. 4 is a timing diagram illustrating an example of a sequence of pulses generated by X-ray emitter 12 (waveform A) and a sequence of pulses generated by X-ray emitter 18 (waveform B) in accordance with this embodiment. In this example, the pulse repetition rate of emitter 12 is four times that of emitter 18; thus, the detections from detector 16 are used to generate the primary planar image, while the detections from detector 20 are used to generate the secondary planar image. As seen in FIG. 4, waveform B is periodic, while waveform A is not strictly periodic (in the sense that the time interval between successive pulses is not constant). Rather, waveform A is a sequence of periodic pulses with periodic omissions, with the omissions corresponding to the timing of the emission of the pulses in waveform B. Stated differently, in a time period during which several (more that two) pulses are emitted by emitter 18, a time interval between emission of successive pulses from emitter 12 is not constant. It should be understood from this embodiment that the term "pulse repetition rate" does not imply a strictly periodic emission of pulses from an emitter; rather, the pulse repetition rate refers to the average number of pulses transmitted during a unit period of time. Again, it is preferable that the pulse repetition rate of the pulses used to form the primary planar image be an integer multiple of the pulse repetition rate of the pulses used to form the secondary planar image to simplify pulse interleaving, since this allows the pulses in waveform B to be periodic and results in periodic omissions from the primary pulse sequence, as shown in FIG. 4. However, as with the foregoing embodiment, any pulse repetition rates and ratio of pulse repetition rates can be selected. Referring again to the foregoing example of the conventional X-ray biplanar transillumination system generating 60 pulses/second, according to this embodiment of the present invention, the X-ray radiation can be reduced by one half by setting the primary pulse repetition rate to 30 pulses/second with the omission of every 10th pulse (for an effective primary pulse repetition rate of 27 pulses/second) and transmitting the secondary pulses during the omission periods (for an effective secondary pulse repetition rate of 3 pulses/second).

It should be understood that the foregoing two embodiments (i.e., two periodic sequences or two sequences that are jointly periodic) can be two, user-selectable modes of operation within the same X-ray biplanar transillumination system.

The reduction of the pulse repetition rate of the pulses used to generate the secondary planar image results in a reduction in the rate at which new image data is generated to update the secondary planar image. This reduction in the image update capability is not generally problematic, since the secondary planar image is ordinarily referred to only occasionally to provide the user with a three-dimensional perspective of the information in the primary planar image.

Of course, if a greater image update rate is required for a planar image that has been designated as the secondary planar image, the user can increase the pulse repetition rate or interchange the designation of the planar images, such that the planar image of greater interest becomes the primary planar image. To provide flicker-free primary and secondary planar images, a gap-fill memory can be employed so that the displayed images can be refreshed at a rate higher than the pulse repetition rate.

In addition to providing direct control of the pulse repetition rates of the emitter 12 and 18, various other mechanisms may be used to conveniently set the pulse repetition rates. For example, one of the two emitters may be designated as the default primary emitter, and the primary and secondary pulse repetition rates may have default values on power-on which are subsequently adjustable. According to one aspect of the present invention, the input device 28 preferably includes a toggle switch that rapidly interchanges the pulse repetition rates of the two emitters 12 and 18, thereby allowing the user to rapidly redesignate which of the planar images is the primary planar image.

Additionally, the input device 28 optionally allows the user to specify the pulse repetition rates by specifying a total emission rate (e.g., the combined number of pulses per second) and a ratio of the primary pulse repetition rate to the secondary pulse repetition rate. For example, by specifying a total pulse repetition rate of 30 pulse/second and a ratio of 5 to 1, the controller would automatically set the pulse repetition rates to 25 pulses/second and 5 pulses/second.

It should be understood that the novel aspects of the present invention can be incorporated into a biplanar transillumination system capable of monoplanar operation or conventional, alternating-pulse operation. In accordance with another aspect of the present invention, when the biplanar transillumination system 10 is initially operated in monoplanar mode (i.e., when only a single emitter-detector pair is used to image the subject 14 in a single plane) and subsequently operated in biplanar mode, the emitter-detector pair used during monoplanar operation is the default primary emitter-detector pair upon entry into the biplanar mode, and the emitter-detector pair not used in the monoplanar mode is the default secondary emitter detector pair upon entry into the biplanar mode.

As will be understood from the foregoing description of the present invention, the reduction of the pulse repetition rate used to generate the secondary planar image advantageously reduces potentially harmful X-ray emissions and reduces the image processing required to generate the two planar images. This reduction in radiation and processing can be achieved without significant sacrifice in useful information, since the lower pulse repetition rate of the pulses used to generate the secondary planar image provides sufficient information to generate an acceptable secondary planar image which is referred to only occasionally.

While the present invention has been described in connection with a biplanar imaging system, it will be understood that the novel aspects of the invention can be applied in systems that form composite images from signals from two or more directions or systems that form images in more than two planes. For example, the present invention can be used in a system having a third emitter-detector pair that is orthogonal to the first and second emitter-detector pairs. In such a system, signals from the three detectors can be used to form composite three-dimensional images. While the present invention has been described in connection with an X-ray emitting system, it will be understood that the present invention applies to imaging systems radiating any form of energy, and associated radiation emitters 30 and 32, including electromagnetic radiation at other frequencies (e.g., radio frequency (RF), infrared (IR), or ultraviolet (UV)) and systems employing acoustic radiation (e.g., ultrasound). Further, while the present invention has been described in connection with a transillumination system, it will be evident that the present invention can be also be applied in systems that detect reflected or scattered signals, e.g., ultrasonic imaging.

Having described preferred embodiments of a new and improved method and apparatus for multi-planar radiation emission in an imaging system, it is believed that other modifications, variations and changes will be suggested to those skilled in the art in view of the teachings set forth herein. It is therefore to be understood that all such variations, modifications and changes are intended to fall within the scope of the present invention, as defined by the limitations set forth in the appended claims and equivalents thereof.

What is claimed is:

1. An apparatus for generating images of a subject, comprising:

a first energy source emitting first pulses of radiation at a first repetition rate, said first pulses being incident on the subject from a first direction;

a first detector disposed to detect said first pulses after said first pulses have interacted with the subject;

a second energy source emitting second pulses of radiation at a second repetition rate which is different from said first repetition rate, said second pulses being incident on the subject from a second direction and being temporally interleaved with said first pulses such that said first and second pulses are temporally non-overlapping;

a second detector disposed to detect said second pulses after said second pulses have interacted with the subject; and an imaging device for generating images of the subject based on the first and second pulses respectively detected by said first and second detectors.

2. The apparatus according to claim 1, wherein said first and second energy sources respectively emit said first and second pulses such that, in a sequence of said first pulses, a time interval between successive first pulses is constant, and, in a sequence of said second pulses interleaved with said sequence of first pulses, a time interval between successive second pulses is constant.

3. The apparatus according to claim 1, wherein said first and second energy sources respectively emit said first and second pulses such that, in a sequence of interleaved pulses formed of said first and second pulses, a time interval between successive pulses is constant.

4. The apparatus according to claim 3, wherein the first pulse repetition rate is greater than the second pulse repetition rate, and wherein, in a time period during which at least three of said second pulses is emitted by said second energy source, a time interval between emission of successive first pulses is not constant.

5. The apparatus according to claim 1, wherein said first and second energy sources are X-ray sources and said first and second pulses of radiation are pulses of X-ray radiation.

6. The apparatus according to claim 1, wherein said first and second pulses of radiation are pulses of electromagnetic radiation or ultrasonic radiation.

7. The apparatus according to claim 1, wherein said first and second detectors respectively detect first and second pulses transmitted through the subject.

8. The apparatus according to claim 1, wherein said first and second detectors respectively detect first and second pulses reflected from the subject.

9. The apparatus according to claim 1, wherein said first direction and said second direction are substantially orthogonal to each other.

10. The apparatus according to claim 1, wherein said imaging device comprises:

a first imaging device for generating first image data based on detections of said first detector and for generating a first image of the subject from a first perspective corresponding to said first direction; and a second imaging device for generating second image data based on detections of said second detector and for generating a second image of the subject from a second perspective corresponding to said second direction.

11. The apparatus according to claim 10, wherein:

said first detector comprises a first amplifier for amplifying said first pulses;

said first imaging device comprises a first camera housing a first film, said first film being exposed by the amplified first pulses, wherein a rate at which said first film is advanced by said first camera is a function of said first pulse repetition rate;

said second detector comprises a second amplifier for amplifying said second pulses; and said second imaging device comprises a second camera housing a second film, said second film being exposed by the amplified second pulses, wherein a rate at which said second film is advanced by said second camera is a function of said second pulse repetition rate.

12. The apparatus according to claim 10, wherein:

said first imaging device comprises a first display device for displaying said first image based on said first image data; and said second imaging device comprises a second display device for displaying said second image based on said second image data.

13. The apparatus according to claim 12, wherein said first and second display devices respectively display said first and second images in real time.

14. The apparatus according to claim 12, wherein said first image data is digital data and said second image data is digital data.

15. The apparatus according to claim 12, wherein said first image comprises a sequence of individual images each of which corresponds to the first image data of a single one of said first pulses, and said second image comprises a sequence of individual images each of which corresponds to the second image data of a single one of said second pulses.

16. The apparatus according to claim 12, wherein said first image comprises a sequence of individual images each of which corresponds to the first image data of a plurality of said first pulses, and said second image comprises a sequence of individual images each of which corresponds to the second image data of a plurality of said second pulses.

17. The apparatus according to claim 12, wherein:

said first image comprises a sequence of individual images, wherein a rate at which the individual images are displayed on said first display device is a function of said first pulse repetition rate; and said second image comprises a sequence of individual images, wherein a rate at which the individual images are displayed on said second display device is a function of said second pulse repetition rate.

18. The apparatus according to claim 12, wherein said first image and said second image are simultaneously or quasi-simultaneously displayed on said first display device and said second display device, respectively.

19. The apparatus according to claim 1, further comprising a controller for selectively setting the first pulse repetition rate and the second pulse repetition rate.

20. The apparatus according to claim 19, wherein said controller includes means for independently setting the first pulse repetition rate and the second pulse repetition rate.

21. The apparatus according to claim 19, wherein said controller comprises a switch for interchanging said first and second pulse repetition rates.

22. The apparatus according to claim 19, wherein said controller comprises a selector for selecting one of a first mode of operation and a second mode of operation, wherein:

in said first mode of operation, said first and second X-ray sources respectively emit said first and second pulses such that, in a sequence of said first pulses, a time interval between successive first pulses is constant, and, in a sequence of said second pulses, interleaved with said sequence of first pulses, a time interval between successive second pulses is constant; and in said second mode of operation, said first and second X-ray sources respectively emit said first and second pulses such that, in a sequence of interleaved pulses formed of said first and second pulses, a time interval between successive pulses is constant.

23. The apparatus according to claim 1, wherein said first pulse repetition rate is a multiple of said second pulse repetition rate.

24. A method for performing biplanar transillumination of a subject, comprising the steps of:

a) emitting first pulses of energy toward the subject from a first direction at a first repetition rate;

b) detecting said first pulses after said first pulses have interacted with the subject;

c) emitting second pulses of energy toward the subject from a second direction at a second repetition rate which is different from said first repetition rate, said second pulses being temporally interleaved with said first pulses such that said first and second pulses are temporally non-overlapping;

d) detecting said second pulses after said second pulses have interacted with the subject; and e) generating images of the subject based on the detected first and second pulses.

25. The method according to claim 24, wherein said first and second pulses are emitted such that, in a sequence of said first pulses, a time interval between successive first pulses is constant, and, in a sequence of said second pulses interleaved with said sequence of first pulses, a time interval between successive second pulses is constant.

26. The method according to claim 24, wherein said first and second pulses are emitted such that, in a sequence of interleaved pulses formed of said first and second pulses, a time interval between successive pulses is constant.

27. The method according to claim 26, wherein, the first pulse repetition rate is greater than the second pulse repetition rate, and wherein, in a time period during which at least three of said second pulses is emitted, a time interval between emission of successive first pulses is not constant.

28. The method according to claim 24, wherein said first and second pulses emitted in steps a) and c) are pulses of X-ray radiation.

29. The method according to claim 24, wherein said first and second pulses emitted in steps a) and c) are pulses of electromagnetic radiation or ultrasonic radiation.

30. The method according to claim 24, wherein said first and second pulses detected in steps b) and d) are transmitted through the subject.

31. The method according to claim 24, wherein said first and second pulses detected in steps b) and d) are reflected from the subject.

32. The method according to claim 24, wherein said first direction and said second direction are substantially orthogonal to each other.

33. The method according to claim 24, wherein step e) includes the steps of:

e1) generating a first image of the subject from a first perspective corresponding to said first direction; and e2) generating a second image of the subject from a second perspective corresponding to said second direction.

34. The method according to claim 33, wherein:

step b) includes amplifying said first pulses;

step d) includes amplifying said second pulses;

step e1) includes exposing a first film with the amplified first pulses; and step e2) includes exposing a second film with the amplified second pulses, the method further comprising the steps of:

advancing the first film at a rate which is a function of said first pulse repetition rate; and advancing the second film at a rate which is a function of said second pulse repetition rate.

35. The method according to claim 33, wherein:

step b) includes generating first image data from said detected first pulses;

step e1) includes displaying said first image based on said first image data;

step d) includes generating second image data from said detected second pulses; and step e2) includes displaying said second image based on said second image data.

36. The method according to claim 35, wherein said first and second images are displayed in real time.

37. The method according to claim 35, wherein said first and second image data are generated as digital data.

38. The method according to claim 35, wherein step e1) includes displaying a sequence of individual images each of which corresponds to the first image data of a single one of said first pulses, and wherein step e2) includes displaying a sequence of individual images each of which corresponds to the second image data of a single one of said second pulses.

39. The method according to claim 35, wherein step e1) includes displaying a sequence of individual images each of which corresponds to the first image data of a plurality of said first pulses, and wherein step e2) includes displaying a sequence of individual images each of which corresponds to the second image data of a plurality of said second pulses.

40. The method according to claim 35, wherein:

step e1) includes periodically adjusting said first image in accordance with said first image data generated from a sequence of said first pulses, wherein a rate at which said first image data is used to adjust said first image is a function of said first pulse repetition rate; and step e2) includes periodically adjusting said second image in accordance with said second image data generated from a sequence of said second pulses, wherein a rate at which said second image data is used to adjust said second image is a function of said second pulse repetition rate.

41. The method according to claim 35, wherein said first image and said second image are displayed simultaneously or quasi-simultaneously.

42. The method according to claim 24, further comprising the steps of:

selectively setting the first pulse repetition rate; and selectively setting the second pulse repetition rate.

43. The method according to claim 42, wherein the first and second pulse repetition rates are set independently.

44. The method according to claim 42, further comprising the step of interchanging said first and second pulse repetition rates.

45. The method according to claim 42, further comprising the step of:

selecting one of a first mode of operation and a second mode of operation, wherein: in said first mode of operation, said first and second pulses are emitted such that, in a sequence of said first pulses, a time interval between successive first pulses is constant, and, in a sequence of said second pulses, interleaved with said sequence of first pulses, a time interval between successive second pulses is constant; and, in said second mode of operation, said first and second pulses are emitted such that, in a sequence of interleaved pulses formed of said first and second pulses, a time interval between successive pulses is constant.

46. The method according to claim 24, wherein said first pulse repetition rate is a multiple of said second pulse repetition rate.

* * * * *